US006565407B1

(12) United States Patent
Woolington et al.

(10) Patent No.: US 6,565,407 B1
(45) Date of Patent: May 20, 2003

(54) TALKING DOLL HAVING HEAD MOVEMENT RESPONSIVE TO EXTERNAL SOUND

(75) Inventors: John Woolington, Harbor City, CA (US); Virgil Wulff, Fullerton, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/496,484

(22) Filed: Feb. 2, 2000

(51) Int. Cl.[7] ..... A63H 30/00; A63H 3/28

(52) U.S. Cl. ..... 446/175; 446/300; 446/301; 446/338; 446/384

(58) Field of Search ..... 446/175, 300, 446/301, 338, 384, 391, 369

(56) References Cited

U.S. PATENT DOCUMENTS

| | | | | | |
|---|---|---|---|---|---|
| 4,221,927 | A | | 9/1980 | Dankman et al. | |
| 4,245,430 | A | * | 1/1981 | Hoyt | 446/175 |
| 4,659,919 | A | * | 4/1987 | Price | 446/397 |
| 4,696,653 | A | | 9/1987 | McKeefery | |
| 4,757,491 | A | * | 7/1988 | Koike | 446/175 |
| 4,802,878 | A | * | 2/1989 | Terzian et al. | 446/300 |
| 4,911,676 | A | * | 3/1990 | Fan | 446/300 |
| 4,913,676 | A | | 4/1990 | Koguchi et al. | |
| 4,923,428 | A | | 5/1990 | Curran | |
| 4,950,200 | A | | 8/1990 | Curran | |
| 5,316,516 | A | | 5/1994 | Saitoh | |
| 5,324,225 | A | | 6/1994 | Satoh et al. | |
| 5,356,326 | A | | 10/1994 | Ting | |
| 5,376,038 | A | | 12/1994 | Arad et al. | |
| 5,407,376 | A | * | 4/1995 | Avital et al. | 446/175 |
| 5,607,336 | A | | 3/1997 | Lebensfeld et al. | |
| 5,713,779 | A | * | 2/1998 | Chen | 446/353 |
| 5,735,726 | A | | 4/1998 | Cohen | |
| 5,855,502 | A | * | 1/1999 | Truchsess | 446/301 |

* cited by examiner

*Primary Examiner*—Derris H. Banks
*Assistant Examiner*—Kurt Fernstrom
(74) *Attorney, Agent, or Firm*—Roy A. Ekstrand

(57) ABSTRACT

A doll includes a plush doll body having a movable head. A body housing within the doll body supports a control and sound circuit which is operatively coupled to a bidirectional motor drive system operative to move the head from side-to-side. A mouth moving mechanism is independently provided within the doll head. The body housing supports a pair of outwardly facing microphones on the right and left side of the housing to detect sound from either side. The control and sound circuit compares the sound energy received by the right side and left side microphones and determines the appropriate direction to pivot or rotate the head to simulate a "listening" attention by the doll.

2 Claims, 3 Drawing Sheets

TALKING DOLL HAVING HEAD MOVEMENT RESPONSIVE TO EXTERNAL SOUND

FIELD OF THE INVENTION

This invention relates generally to talking dolls and particularly to those having additional features to enhance realism in interactive play patterns with children.

BACKGROUND OF THE INVENTION

With the development of relatively low cost commercially available digital sound circuits, practitioners in the toy arts have endeavored to provide various toys with sound or speech capability. One of the most pervasive uses of digital sound producing circuits is found in dolls which exhibit a capability for speaking. Such speaking dolls often include additional features which further enhance the realism of the speaking activity. Thus, dolls have been provided which include movement mechanisms in addition to the speech apparatus to provide realistic features such as mouth movement or the like. While the fabrication of electronic sound producing circuits of the type used in dolls or other toys is subject to substantial variation, all generally include a sound processor or controller together with a memory suitable for storing the digital signals corresponding to various predetermined words phrases or sounds. Such circuits typically utilize a power amplifier to provide sufficient audio power to the audio signals developed by the processor to enable the circuit to drive an acoustic transducer such as a speaker or the like. Throughout the development of speaking and sound producing toys, the direction of development and the challenge to the practitioner of the toy arts has been to provide evermore interesting and amusing talking and sound producing toys.

Not surprisingly, the continued popularity of sound producing toys has prompted practitioners in the toy arts to endeavor to provide ever increasing sophistication and capability in such toys. For example, U.S. Pat. No. 4,245,430 issued to Hoyt sets forth a VOICE RESPONSIVE TOY which seeks an emitted sound such as a child's voice. The toy include control circuitry for activating an associated drive mechanism to turn and/or guide the toy toward the child's voice. A battery-powered motor drive system responds to the control circuitry to move the toy physically in the direction of the detected sound.

U.S. Pat. No. 4,696,653 issued to McKeefery sets forth a SPEAKING TOY DOLL which responds with spoken words and/or sentences to the touching of selected portions of the doll by a user. The toy further includes voice actuation in response to the user's speech which is sensed by a microphone within the toy. In response to the user's speech, the toy randomly selects a sentence which is audibilized by the speech circuitry within the doll.

U.S. Pat. No. 5,324,225 issued to Satoh, et al. sets forth an INTERACTIVE TOY FIGURE WITH SOUND-ACTIVATED AND PRESSURE-ACTIVATED SWITCHES having a toy body resembling a kitten including an extending tail. An operative mechanism within the toy body utilizes a battery-powered motor drive to articulate the toy kitten's tail.

U.S. Pat. No. 4,923,428 issued to Curran sets forth a INTERACTIVE TALKING TOY which speaks and moves certain body parts such as eyes, mouth, head and arms under the control of a microprocessor. Program material selected from a tape storage device incorporated within the body of the toy is used by the processor to respond to human speech.

U.S. Pat. No. 4,221,927 issued to Dankman, et al. sets forth a VOICE-RESPONSIVE TALKING TOY which in response to a complex sound such as human speech generates a train of audio pulses. The pulses are pseudo-random with respect to frequency composition and duration. The resulting sounds simulate syllabic speech.

U.S. Pat. No. 4,913,676 issued to Koguchi, et al. sets forth a MOVING ANIMAL TOY having a motor operatively coupled to the upper and lower pivotally supported beaks of a bird-like body. Additional apparatus also driven by the motor slowly twists the head of the toy sideways. When a voice is uttered against the toy, it is received through a microphone by a voice recording and reproducing device. After a specified time elapses, the voice is reproduced by the toy.

U.S. Pat. No. 4,950,200 issued to Currin sets forth a WHISPERING DOLL having a tape deck processing an endless loop tape upon which multiple tracks of speech are stored. The tape playing device is responsive to a plurality of switches placed about the toy body.

U.S. Pat. No. 5,316,516 issued to Saitoh sets forth an ANIMATED SINGING TOY BIRD WITH EXTERNAL STIMULUS SENSOR capable of carrying out movement simulating a real bird. The body is arranged so as to be movable with respect to the leg section and the head is further movable with respect to the body. The toy bird may be actuated to produce bird-like sounds in response to sound, light or other stimulus.

U.S. Pat. No. 5,356,326 issued to Ting sets forth a SHAKING TOY having a plush figure resembling a monkey supported within a surrounding cage. In response to stimulus, the toy figure swings back and forth in the cage. An accompanying sound is generated within the toy figure.

U.S. Pat. No. 5,376,038 issued to Arad, et al. sets forth a DOLL WITH PROGRAMMABLE SPEECH ACTIVATED BY PRESSURE ON PARTICULAR PARTS OF HEAD AND BODY in which a doll includes an internal speech producing mechanism together with a plurality of pressure responsive switches supported upon different portions of the body. The speech system responds to the stimulus of one or more of the body supported switches to produce sound.

U.S. Pat. No. 5,607,336 issued to Lebensfeld, et al. sets forth a SUBJECT SPECIFIC WORD/PHRASE SELECTABLE MESSAGE DELIVERING DOLL OR ACTION FIGURE which is capable of providing when activated words or phrases specifically relating to a particular subject, activity, profession or other area of interest for which the doll or action figure is dressed. This selectability is provided by utilizing a doll or action figure which incorporates an audio generator contained therein together with message containing components removably connected with the outfits of wearing apparel.

U.S. Pat. No. 5,735,726 issued to Cohen sets forth a ANIMATED SITTING AND STANDING SANTA CHAR- ACTER having a base upon which a chair is supported together with a toy figure resembling Santa Claus. The toy figure is multiply articulated and is coupled to a drive mechanism which allows the toy figure to move between a standing and seated position upon the chair.

While the foregoing described prior art devices have to some extent improved the art and in some instances enjoyed commercial success, there remains nonetheless a continuing need in the art for evermore improved, interesting and amusing toy figures and dolls which utilize speech simulation.

SUMMARY OF THE INVENTION

Accordingly, it is a general object of the present invention to provide an improved talking doll. It is a more particular object of the present invention to provide an improved talking doll having a head movement which provides a more realistic response by the doll.

In accordance with the present invention, there is provided a talking doll comprising: a doll body having a torso and a head; a body housing supported within the torso-and defining an interior body cavity; a head housing within the head pivotally coupled to the body and defining an interior head cavity; a reversible motor supported within the interior body cavity; first gear means operatively driven by the reversible motor; a shaft coupler operatively driven by the first gear means; a shaft having a first end engaging the shaft coupler and a second end; a head coupler coupling the second end to the head housing; a control and sound circuit having a left microphone, a right microphone, sound producing means and means responsive to the microphones to energize the reversible motor in a first direction in response to sound energizing the left microphone and in a second direction in response to sound energizing the right microphone; and a position switch operatively coupled to the shaft coupler providing an off signal to the control and sound circuit when the shaft coupler is pivoted left or right beyond a predetermined position, the head being pivoted to left or right in response to sound from left or right respectively.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
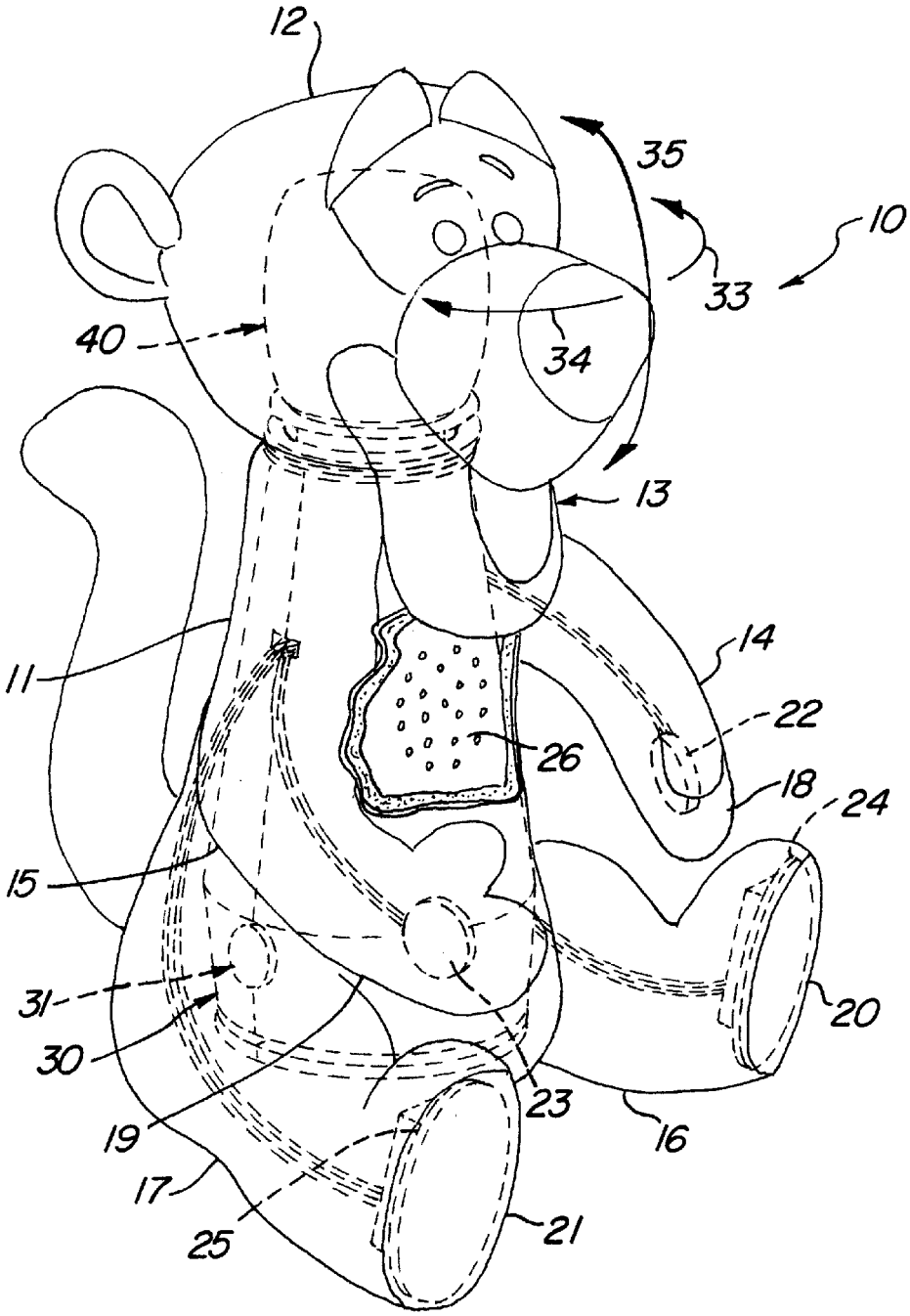
FIG. 1 sets forth a partially sectioned front perspective view of a doll constructed in accordance with the present invention.

FIG. 1 sets forth a partially sectioned front perspective view a doll constructed in accordance with the present invention and generally referenced by numeral 10. Doll 10 includes a body 11 formed of a conventional plush fabrication material and having a head 12, a pair.of arms 14 and 15, and a pair of legs 16 and 17. Arms 14 and 15 support hands 18 and 19 while legs 16 and 17 support feet 20 and 21. Head 12 further defines a movable mouth 13. In the preferred fabrication of the present invention, hands 18 and 19 support pressure responsive switches 22 and 23 while feet 20 and 21 support switches 24 and 25.

In further accordance with the present invention, body 11 supports a relatively rigid body housing 30 which in turn supports a movable head housing 40 within head 12. Housing 40 is pivotably joined to body housing 30 by means set forth below in greater detail. The frontal portion of body housing 30 further supports a speaker grille 26 having a plurality of sound emitting apertures formed therein.

Figure 2:
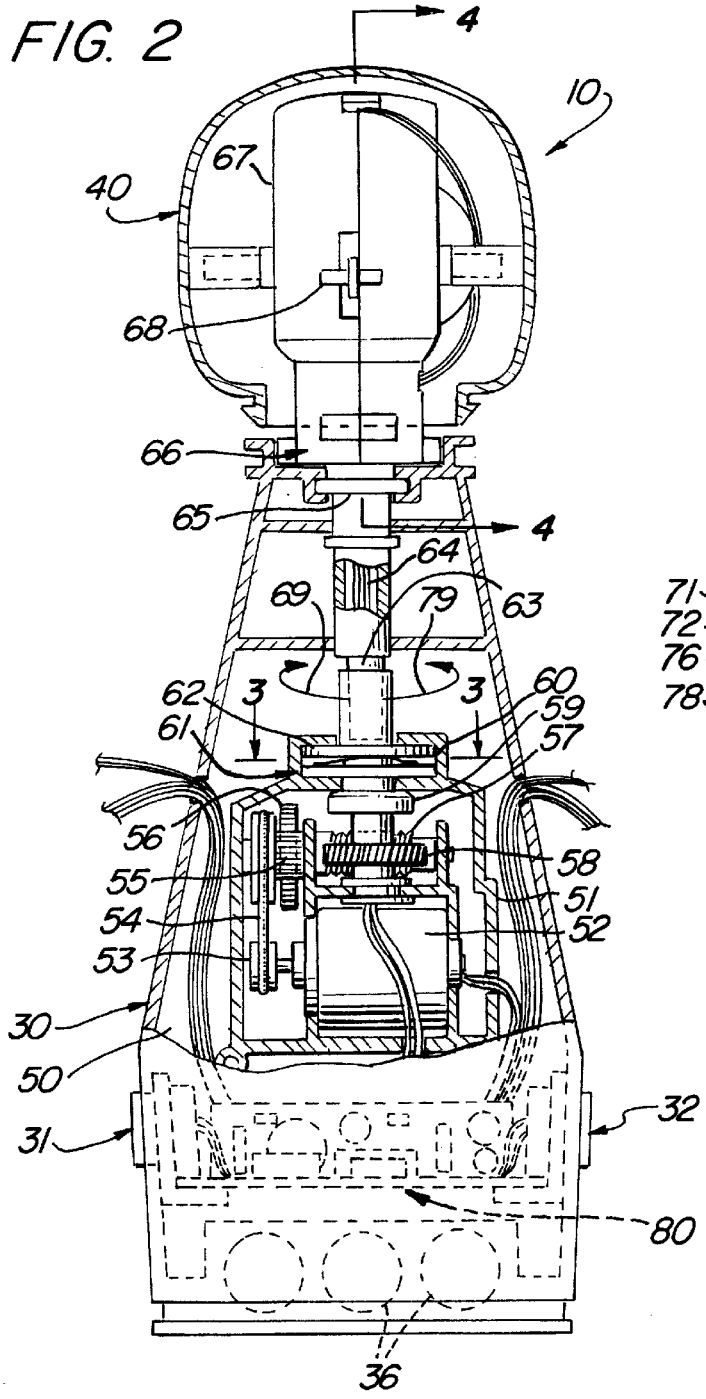
FIG. 2 sets forth a partially sectioned front view of the housing and operative mechanism of the present invention talking doll.

In accordance with an important aspect of the present invention, body housing 30 supports a right side microphone 31 and a left side microphone 32 (microphone 32 seen in FIG. 2).

By means set forth below in greater detail, head housing 40 is moved with respect to body housing 30 in response to sound detected by microphones 31 and 32 (microphone 32 seen in FIG. 2). In further accordance with the operative mechanism set forth below in greater detail, sound detected at right microphone 31 triggers a movement of head housing 40 and head 12 in the direction indicated by arrow 34. Conversely, the operative mechanism within body housing 30 set forth below responds to sound detected by left side microphone 32 (seen in FIG. 2) by pivoting head housing 40 and head 12 in the direction indicated by arrow 33. Concurrently, a sound producing circuit set forth below in greater detail within body housing 30 causes predetermined sounds to be emitted from speaker grille 26. In accordance with the operative mechanism set forth below in FIG. 4 in greater detail, mouth 13 is moved up and down in the directions indicated by arrows 35 each time sound is outputted through speaker grille 26 to give doll 10 the appearance of speaking.

In operation, the user is able to activate the sound circuit within doll 10 by actuating switches 22, 23, 24 or 25 to stimulate sound production by the sound circuit within doll 10. In addition, doll 10 responds to sound detected from sources on either side of the doll by turning head 12 toward the source of sound. This direction determination utilized in turning head 12 in the proper direction is provided by the system set forth below in greater detail. However, suffice to note here that sound reaching doll 10 from its right side is maximally detected by right side microphone 31 while sound reaching doll 10 from its left side is maximally detected by left side microphone 32 (seen in FIG. 2). In response to detected sound which is maximum from either microphone, doll 10 is actuated to pivot head 12 in the corresponding direction. This action allows doll 10 to exhibit an apparent reaction to a child user speaking or other sounds by turning in the appropriate direction toward the source. This action greatly enhances the realism and interactive appearance of doll 10.

FIG. 2 sets forth a partially sectioned front view of body housing 30 and head housing 40 showing the operative mechanism of the present invention doll therein. As described above, body housing 30 supports a right side microphone 31 and a left side microphone 32. As is also described above, body housing 30 is coupled to a pivotally supported head housing 40. Head housing 40 and body housing 30 are joined by a head coupler 66 which is set forth below in FIG. 4 in greater detail. A plurality of batteries 36 are supported within the bottom end of body housing 30. Additionally, a control and sound circuit 80 is also supported within body housing 30. Body housing 30 defines an interior cavity 50 within which a motor housing 51 is supported. Motor housing 51 supports a motor 52 having an output pulley 53 driven thereby. Pulley 53 is coupled to a combination pulley and gear 55 by a belt 54. The gear portion of combination pulley and gear 55 engages a gear 56 which in turn drives a worm gear 57.

A coupler 59 supports a gear 58 engaging worm gear 57. Coupler 59 further supports a rotary switch 61 and a bearing 62. Switch 61 and bearing 62 are supported within a slot 60 formed within motor housing 51. The upper end of coupler 59 receives the bottom end of a shaft 63. Shaft 63 extends upwardly through body housing 30 and is rotatably supported by a bearing 65. By means set forth below in FIG. 4 in greater detail, the upper end of shaft 63 passes through bearing 65 and engages head coupler 66 of head housing 40. Thus, head housing 40 is pivotally movable in response to pivotal movement of shaft 63 in the manner indicated by arrows 69 and 79. Shaft 63 is hollow allowing a plurality of wires 64 to pass upwardly from sound and control circuit 80 into mouth drive housing 67.

The apparatus within mouth drive housing 67 is set forth below in FIG. 4 in greater detail. However, suffice it to note here that mouth drive housing 67 includes a forwardly extending mouth link 69 which in the manner described below is operative to manipulate mouth 13 (seen in FIG. 1) to simulate mouth movement during speaking action of doll 10.

In operation, motor 52 responds to control and sound circuit 80 in the manner described below in FIG. 5 to rotate either direction. Sound and control circuit 80 responds to sound energy received by right microphone 31 and left microphone 32 to actuate motor 52 in a corresponding direction. Thus, for example, sounds reaching doll 10 from the doll's right side provide maximal energy at right side microphone 31 in response to which sound and control circuit 80 energizes motor 52 to rotate in a corresponding direction. The rotation of motor 52 rotates output pulley 53 which in turn rotates combination pulley and gear 55 through the coupling of belt 54. As combination pulley and gear 55 rotates in a selected direction, gear 56 drives worm gear 57 in a resulting direction of rotation. Gear 58 is rotated by the rotation of worm gear 57 to produce rotation of coupler 59 and shaft 63. Because the maximal sound energy was received at right side microphone 31, sound and control circuit 80 selected the direction of rotation of motor 52 which would result in rotation of coupler 59 and shaft 63 in the direction indicated by arrow 69. The engagement of shaft 63 with coupler 59 and the further engagement of shaft 63 with head coupler 66 causes head housing 40 to correspondingly pivot or rotate in the direction indicated by arrow 69. The result of this action is a movement of the head of doll 10 in the manner described above in FIG. 2 to produce a head turning toward the detected source of sound providing a realistic response to the speaking child or other sound source. In accordance with the operation of switch 61 described below in conjunction with FIG. 3, motor 52 remains energized by sound and control circuit 80 and thereby continues to pivot or rotate coupler 59 and shaft 63 until switch 61 reaches a predetermined position at which point switch 61 produces a signal coupled to sound and control circuit 80 which terminates the energizing of motor 52. This in turn stops head housing 40 at a predetermined angular position to the right side of doll 10.

Conversely, the detection of maximal sound energy by left side microphone 32 causes control and sound circuit 80 to energize motor 52 in the opposite direction of rotation. This opposite direction rotation is coupled through pulley 53 and belt 54 to combination pulley and gear 55. This in turn rotates gear 56 and worm gear 57 in the opposite direction to that caused by energizing of right side microphone 31. Correspondingly, gear 58 and coupler 59 are rotated in the direction indicated by arrow 79. This rotation or pivotal movement in the direction indicated by arrow 79 causes a corresponding pivotal movement or rotation of head housing 40 to produce the left side turning movement of doll 10 indicated by arrow 33 in FIG. 1. Once again, in accordance with the operation of switch 61 set forth below in FIG. 3 in greater detail, once coupler 59 has rotated or pivoted to a predetermined left side direction, the operation of switch 61 produces a signal condition which causes control and sound circuit 80 to cease energizing motor 52. This in turn terminates the rotation or pivotal movement of head housing 40 and head 12 (seen in FIG. 1) to the left side of doll 10.

In the preferred fabrication of the present invention, control and sound circuit 80 responds to an absence of sound energy at right side microphone 31 and left side microphone 32 extending beyond a predetermined time to energize motor 52 so as to return head housing 40 and head 12 to the forwardly extending rotational position shown in FIG. 1.

Figure 3:
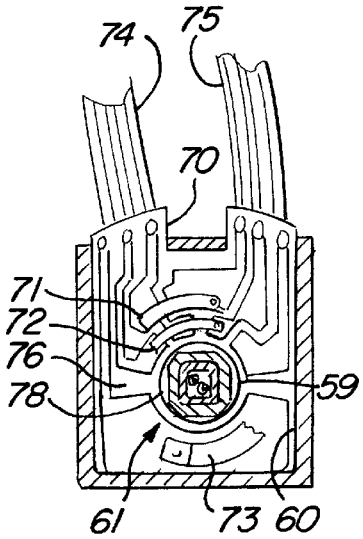
FIG. 3 sets forth a partial section view of the operative mechanism of the present invention talking doll taken along section lines 3—3 in FIG. 2.

FIG. 3 sets forth a section view of switch 61 taken along section lines 3—3 in FIG. 2. As described above, switch 61 is supported within a slot 60 formed in motor housing 51 (seen in FIG. 2). Switch 61 may be constructed in accordance with conventional fabrication techniques utilizing a printed circuit board 70 upon which a plurality of conductive paths 76 are formed. A plurality of connecting wires 74 and 75 operatively couple conductive paths 76 of printed circuit board 70 to motor control and sound circuit 80 (seen in FIG. 2). In accordance with conventional fabrication techniques, switch 61 includes a rotating member 78 which is engaged by coupler 59 and which supports a plurality of movable contacts 71, 72 and 73. The operation of switch 61 is substantially conventional in that it functions by the interaction of conductive paths 76 and contacts 71, 72 and 73 to provide the appropriate electrical signals to sound and control circuit 80 in response to rotational position of rotating element 78. The position of rotating element 78 corresponds directly to the position of coupler 59. As a result, the pivoting or rotating of coupler 59 described below in response to energizing of motor 52 causes a corresponding movement of contacts 71, 72 and 73 with respect to conductive paths 76. At each selected position of conductive paths 76, the desired one of contacts 71, 72 or 73 is moved upon the desired one of conductive paths 76 to produce an appropriate position signal for control and sound circuit 80 (seen in FIG. 2).

Figure 4:
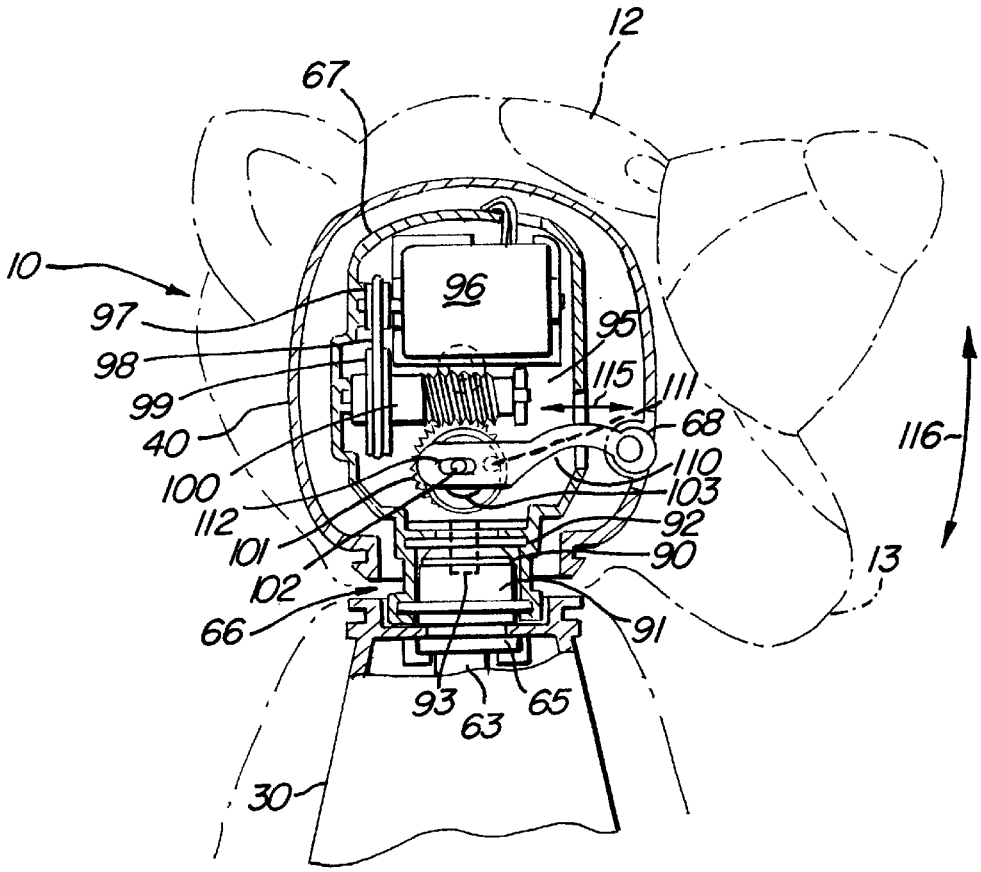
FIG. 4 sets forth a partial section side elevation view of the head moving mechanism of the present invention talking doll.

FIG. 4 sets forth a partially sectioned side view of head housing 40 and mouth drive housing 67 together with the mouth moving mechanism supported therein. Doll 10 includes a body housing 30 supporting a head housing 40. Head housing 40 includes a mouth drive housing 67 secured thereto by conventional fasteners (not shown). Mouth drive housing 67 is joined to a head coupler 66.

Body housing 30 supports an upwardly extending shaft 63 having a bearing 65 and an upper end 90. End 90 of shaft 65 passes through a bearing 91 supported within head coupler 66. Mouth drive housing 67 includes a plate 92 having a downwardly extending tab 93 which is received within and which engages end 90 of shaft 63. Thus, the rotational or pivotal movement of shaft 63 described below in conjunction in FIG. 2 is imparted to mouth drive housing 67 and head housing 40 through the engagement of tab 93 within end 90 of shaft 63. Bearing 91 facilitates this pivotal or rotational movement.

Mouth drive housing 67 includes an interior cavity 95 supporting a motor 96. Motor 96 includes an output pulley 97 which is coupled to a pulley 99 by a belt 98. Pulley 99 is joined to a worm gear 100 which is rotatably supported within interior cavity 95. A gear 101 is rotatably supported upon a shaft 102 within interior cavity 95 and further supports an eccentric cam 103. A movable arm 110 includes a link 68 at its outer end and a slot 112 at its inner end. Arm 110 further includes a pin 111 which engages eccentric cam 103. A slot 112 is formed in arm 110 and receives shaft 102.

In operation, control and sound circuit 80 (seen in FIG. 2) provides operative power to motor 96 energizing motor 96 and rotating output pulley 97. The rotation of pulley 97,is coupled to worm gear 100 via belt 98 and pulley 99. Rotation of worm gear 100 rotates gear 101 which in turn rotates eccentric cam 103. As cam 103 rotates, pin 111 is moved forwardly and rearwardly in an oscillatory motion indicated by arrows 115. Link 68 is joined to the fabric forming mouth 13 of head 12 in a conventional attachment (not shown) such that the front to back oscillatory motion of link 68 caused by the motion of arm 110 moves mouth 13 vertically in the directions indicated by arrows 116. This movement simulates the speaking action of doll 10. In the preferred fabrication of the present invention, motor 96 is energized by control and sound circuit 80 (seen in FIG. 2) each time doll 10 speaks.

In accordance with the preferred fabrication of the present invention, it will be noted that the operative coupling between shaft 63 and head housing 40 together with the provision of an independent mouth moving mechanism energized by motor 96 within mouth drive housing 67 allows mouth 13 to be moved during speech regardless of the pivotal or rotational position of head 12. Accordingly, doll 10 is able to do the mouth movement concurrent with speech regardless of whether head 12 is pivoted to the left side, right side or any position therebetween.

Figure 5:
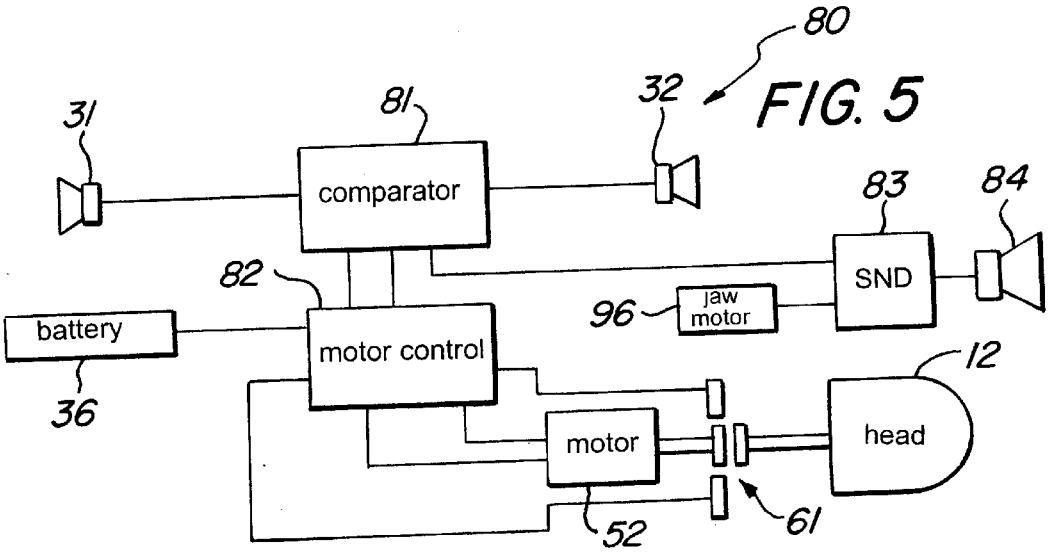
FIG. 5 sets forth a block diagram of the control system operative within the present invention talking doll.

FIG. 5 sets forth a block diagram of control and sound circuit 80. Control and sound circuit 80 includes a comparator 81 operatively coupled to right microphone 31 and left microphone 32. Comparator 80 provides a pair of output signals to a motor control 82. Motor control 82 receives operative power from battery 36 and is further coupled to a bidirectional motor 52. Motor 52 is mechanically coupled in the manner set forth above in FIG. 2 to a position switch 61. A head 12 is mechanically coupled to motor 52 in the manner described above in FIGS. 2 and 4. Switch 61 is further coupled back to motor control 82. A sound circuit 83 is coupled to comparator 81 and produces sound output signals which are coupled to a conventional speaker 84. A jaw motor 96 is operatively coupled to sound circuit 83.

In operation, comparator 81 receives electrical signals in response to external sound from either or both of microphones 31 and 32. In the event either microphone is energized solely in response to sound from either side of the present invention doll, comparator 81 produces a signals indicative of the microphone side which is energized. This signal is applied to motor control 82. In the event both microphones 31 and 32 receive sound simultaneously, comparator 81 functions in the manner set forth in the above-described prior art systems to determine the greater sound energy received between microphones 31 and 32. In response to the determination of the greater sound energy received, comparator 81 produces a corresponding direction control signal to motor control 82.

Motor control 82 responds to a direction signal from comparator 81 to energize bidirectional 52 in a corresponding direction of rotation. The rotation of motor 52 is mechanically coupled to a position switch 61 and to head 12. Correspondingly, head 12 and switch 61 are rotatably moved until the position obtained by switch 61 corresponds to a shutoff or termination position. Once motor 52 has rotated switch 61 in a given direction a sufficient distance to cause switch 61 to turn off,- a signal condition is returned to motor control 52 causing the termination of operation of motor 52. This in turn terminates the pivotal or rotational movement of head 12.

Comparator 81 may also respond to the input energy received at microphones 31 or 32 to energize sound circuit 83. Energizing sound circuit 83 causes an output applied to speaker 84 corresponding to a selected stored audio response. Additionally, sound circuit 83, when energized to produce sound, also activates jaw motor 96 causing the simulation of mouth movement described above in FIG. 4. Once the operation of sound-circuit 83 terminates, a corresponding termination of mouth movement also occurs.

Thus, what is provided by the present invention doll is a simple and straight forward system by which a plush doll is provided with head motion simulating the doll directing its attention to sound received from either side due to the position of a sound source such as a child user. In the preferred fabrication of the present invention, the inventive doll is responsive to virtually any sound source on either side of the doll to provide the head turning movement in apparent "listening" response to the sound. Thus, the present invention doll is able to participate in a further play pattern in which a second similar doll is positioned in reasonable proximity to the inventive doll. Under this circumstance, a pair of the present invention dolls together with the child user may provide response to each doll as it speaks and to the child user as the child also speaks. A further plurality of dolls may be used such as three or four or more dolls to provide further amusement and play value.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What which is claimed is:

1. A talking doll comprising:

a doll body having a torso and a head;

a body housing supported within said torso and defining an interior body cavity;

a head housing within said head pivotally coupled to said body and defining an interior head cavity;

a reversible motor supported within said interior body cavity;

first gear means operatively driven by said reversible motor;

a shaft coupler operatively driven by said first gear means;

a shaft having a first end engaging said shaft coupler and a second end;

a head coupler coupling said second end to said head housing;

a control and sound circuit having a left microphone, a right microphone, sound producing means and means responsive to said microphones to energize said reversible motor in a first direction in response to sound energizing said left microphone and in a second direction in response to sound energizing said right microphone;

a movable mouth supported by said head and means for moving said mouth including a single direction motor supported within said interior head cavity wherein said sound circuit causes said means for moving said mouth to be active simultaneously with sound production; and a position switch operatively coupled to said shaft coupler providing an off signal to said control and sound circuit when said shaft coupler is pivoted left or right beyond a predetermined position, said head being pivoted to left or right in response to said sound from left or right respectively and said means for moving said mouth operating independent of left or right pivoting head movement.

2. The talking doll set forth in claim 1 wherein said control and sound circuit includes a comparator coupled to said left and right microphones producing a signal for selecting said first or second direction energizing of said reversible motor.

* * * * *